US005477756A

United States Patent [19]

Trankiem et al.

[11] Patent Number: 5,477,756

[45] Date of Patent: Dec. 26, 1995

[54] METHOD OF APPLYING POLYMERS TO RAZOR BLADE CUTTING EDGES

[75] Inventors: Hoang M. Trankiem, Watertown; Manohar S. Grewal, Hanover, both of Mass.

[73] Assignee: The Gillette Company, Boston, Mass.

[21] Appl. No.: 125,096

[22] Filed: Sep. 22, 1993

[51] Int. Cl.[6] ..... B21K 11/00

[52] U.S. Cl. ..... 76/104.1; 30/346.54; 76/DIG. 8

[58] Field of Search ..... 76/104.1, DIG. 8; 30/346.54, 330; 427/318

[56] References Cited

U.S. PATENT DOCUMENTS

| | | | |
|---|---|---|---|
| H640 | 6/1989 | Nizel | 427/45.1 |
| 3,219,460 | 11/1962 | Brown . | |
| 3,224,900 | 12/1965 | Creamer et al. | 117/119 |
| 3,302,632 | 2/1967 | Fichtner . | |
| 3,394,007 | 7/1968 | Campbell . | |
| 3,547,661 | 12/1970 | Stevenson . | |
| 4,128,941 | 12/1978 | Holsappie | 30/151 |
| 4,230,924 | 10/1980 | Brastad et al. | 219/10.55 E |
| 4,495,392 | 1/1985 | Derby | 219/10.55 E |
| 4,676,857 | 6/1987 | Scharr et al. | 156/233 |
| 4,777,336 | 10/1988 | Asmussen | 219/10.55 M |

FOREIGN PATENT DOCUMENTS 1416887 12/1975 United Kingdom .

OTHER PUBLICATIONS

Asmussen et al, "Single–Mode or Controlled multimode microwave cavity Applicatiors For Precious Materials Processing", Rev. Sci. Instrum, vol. 58, No. 8 pp. 1477–1486 (Aug. 1987).

Patil et al, "Microwave Sintering of $Al_2O_3$:$ZrO_2$ Ceramics", Proceedings of the American Ceramic Society Symposium on Microwaves, Apr. 28–May 2, 1991.

Wavemat, Inc., Prod. Brochure on Model MCR2200 Microwave Resch System.

Wavemat, Inc. Prod. Brochure on Model MCR1100 Microwave Research Syst.

*Primary Examiner*—Douglas D. Watts

*Attorney, Agent, or Firm*—Chester Cekala

[57] ABSTRACT

A method of manufacturing a razor blade is disclosed wherein a polymer material is coated onto the blade edge. The polymer material is applied to the blade edge in a coating solution after which the blade is heated to melt the polymer via a radio frequency source, preferably a microwave source.

13 Claims, 1 Drawing Sheet

METHOD OF APPLYING POLYMERS TO RAZOR BLADE CUTTING EDGES

FIELD OF THE INVENTION

The present invention relates to the manufacture of razor blades and more particularly to the manufacture of a razor blade having a coating of polymeric material disposed on the edge surfaces thereof.

BACKGROUND OF INVENTION

In the prior art, it is known to manufacture razor blades having various coatings which have been developed to provide the blades with a protection against abrasion and atmospheric conditions as well as contact with various materials during storage or the shaving process which materials would tend to degrade the basic material of the blade.

In addition to the protection of the material from which the blade is manufactured, the various coating supplied to the blade edges have been formulated with an attempt to eliminate the undesirable effects which occur in the shaving process that may cause irritation to the skin of the blade user. Materials exhibiting a low coefficient of friction are commonly used for this purpose.

In order to accomplish the above, blades have been treated by the coating of a polymeric material to the surface of the blade cutting edge by means of a melting process. Generally, the process of applying the polymer material to the razor blade is accomplished by spraying a polymeric material dispersed in solution to the blade and heating the blade in a non-oxidizing environment causing the polymeric material to melt and spread onto the blade edge surface. When the blade is ultimately cooled, the coating solidifies and remains adhered to the blade. Heating of the blade to produce this melting has, in general, been accomplished by infrared, inductive or resistance heating of the blade to a temperature in a range of between 200° C. to 400° C. Various examples of such a process are disclosed in U.S. Pat. No. 3,224,900 to Creamer et al and U.S. Statutory Invention Registration H640 to Nizel.

Resistance and inductive heating have high energy consumption and take long a time to heat the blades, since they heat the entire mass of blades including the blade carrier or fixtures. Although infrared heating is slightly faster than resistance or inductive heating—taking only 40 seconds to heat a foot long (12 inch ) stack of blades compared with about 20 to 30 minutes in resistance or inductive heating—the processing window is actually quite small due to the emissivity of the blade stacks which vary with the angle of sharpened blades. Furthermore, the cooling time required before the coating solidifies enough for the blades to be handled is still quite long.

It is an object of the present invention to provide an improvement to the prior art process of applying a coating of polymeric material to the edge surfaces of a razor blade through the introduction of radio frequency heating, preferably microwave heating, in the manufacturing process.

Another object of the invention is to reduce the heating and cooling times required to meld and solidify polymeric coating materials without adversely effecting the blade edge.

An additional object is to produce coated blades with good bonding of polymer to the substrate cutting edge.

Still a further object of the invention is to reduce the energy requirements for melting of the polymeric material to the blade edge surface by the use of microwave energy.

SUMMARY OF THE INVENTION

The present invention relates to a method of manufacturing a razor blade having a coating of polymeric material disposed on the edge surface thereof which includes the steps of: providing a chamber having a non-oxidizing atmosphere therein and a means for delivering radio frequency energy, preferably microwave energy; applying a polymeric material, preferably a fluorocarbon polymer, most preferably polytetrafluoroethylene, to the edge of the blade; and retaining said blade in said cavity whereby the heat induced by said radio frequency energy is effective to raise the temperature of the coated edge surface of said blade and causing said polymeric material to melt.

BRIEF DESCRIPTION OF THE DRAWING

The foregoing and other features of the invention will be more particularly described in connection with the preferred embodiment, and with reference to the accompanying drawing wherein.

DETAILED DESCRIPTION OF THE PRESENT INVENTION

Figure 1:
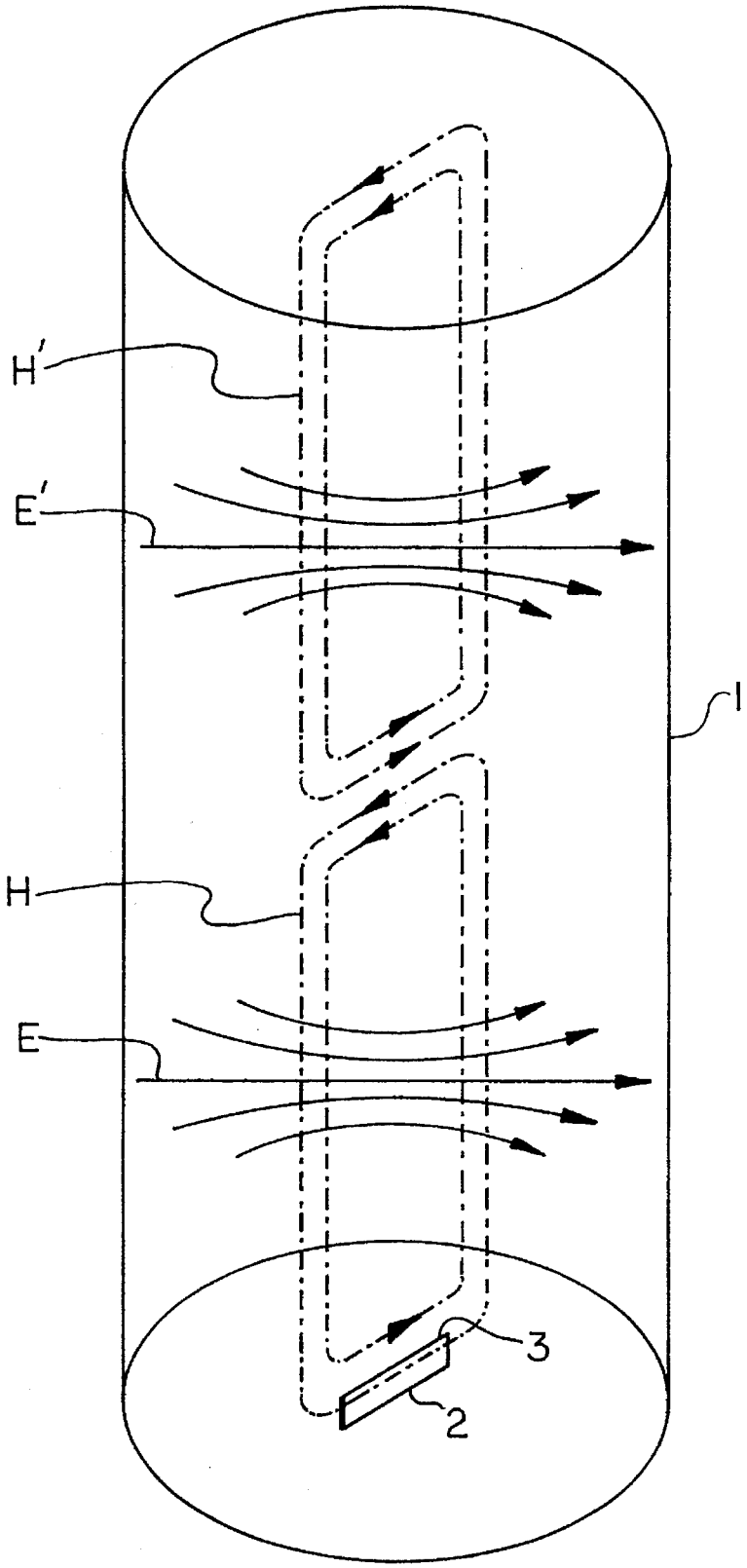
FIG. 1 is a schematic representation of a single mode microwave chamber operating in Transverse Electric mode 112 ($TE_{112}$) wherein a blade is shown parallel to the magnetic field (H) and perpendicular to the electric field (E).

All percentages and ratios described herein are on a weight basis unless otherwise indicated.

As used herein the term "razor blade cutting edge" includes the cutting point and facets of the blade. Applicants recognize that the entire blade could be coated in the manner described herein; however, an enveloping coat of this type is not believed to be essential to the present invention.

The preparation of the razor blades for coating in the present invention is similar to that employed in the prior an:, in that the blades are first cleaned with a solvent or detergent to dissolve grease and dirt which may have accumulated on the blades, and to prepare a surface which is receptive to the coating to be affixed to the blade surface.

After washing the blades, they are dried and placed on a carrier-type device which may be of any type well known in the art, and are coated with the polymeric material. Many commercial razor blades also include a chromium/platinum interlayer between the steel blade and the polymer. This type of interlayer is sputtered onto the blade edge surface prior to polymer coating. Furthermore, the blade material can be coated with a Diamond Like Carbon (DLC) coating as described in U.S. Pat. Nos. 5,142,785 and 5,232,568, incorporated herein by reference., prior to polymer coating.

The polymeric material may be any material which will melt onto a blade cutting edge and remain adhered during several shaves. The polymeric materials are typically, fluorocarbon polymers, silicone-based polymers, or mixtures thereof. Suitable fluorocarbon polymers are those which contain a chain of carbon atoms including a preponderance of $—CF_2—CF_2—$ groups, such as polymers of tetrafluoroethylene, including copolymers such as those with a minor proportion, e.g. up to 5% by weight of hexafluoropropylene. These polymers have terminal groups at the ends of the carbon chains which may vary in nature, depending, as is well known, upon the method of making the polymer. Among the common terminal groups of such polymers are:

$—H$, $—COOH$, $—Cl$, $—CCl_3$, $—CFClCF_2Cl$, $—CH_2OH$, $—CH_3$,

—$CF_2H$, . . . , and the like. While the precise molecular weights and distribution of molecular weights of the preferred polymers are not known with certainty, it is believed that they have average molecular weights below 700,000, most preferably about 25,000. The preferred chlorine-containing polymers are those containing from 0.15 to 0.45% by weight of chlorine (which is present in the terminal groups). There may be used mixtures of two or more fluorocarbon polymers, provided the mixtures have melt and melt flow rate characteristics as specified above, even though the individual polymers making up the mixture do not possess these characteristics. The most preferred starting material is polytetrafluoroethylene.

A dispersion of the polymer in a suitable solvent, such as water, a volatile organic solvent, such as alcohol, Freon® fluorocarbon solvents, or miscible combinations thereof may be applied to the cutting edge in any suitable manner to give as uniform a coating as possible, as for example, by dipping or spraying. Spray coating is the preferred commercial coating method. Nebulization or atomization are especially preferred for coating the cutting edges. An electrostatic field may be employed in conjunction with the nebulizer in order to increase the efficiency of deposition. For further discussion of this electrostatic spraying technique, see U.S. Pat. No. 3,713,873 to Fish, issued Jan. 30, 1973, incorporated herein by reference. Preheating the dispersion may be desirable to facilitate spraying. The extent of preheating depending on the nature of the dispersion.

Once the blade edges are coated, they are heated to drive off the solvent and to melt the polymer causing it to adhere to the blade. The heating operation can result in a sintered, partially melted or melted coating. A totally melted coating is preferred as it allows the coating to spread as a continuous thin film and cover the blade edge more thoroughly. For more detailed discussions of melt, partial melt and sinter, see *McGraw-Hill Encyclopedia of Science and Technology,* Vol. 12, 5th edition, pg. 437 (1992), incorporated herein by reference. While the blades may be heated in an atmosphere of air, it is preferred that they be heated in an atmosphere of inert gas such as helium, nitrogen, etc., or in an atmosphere of reducing gas such as hydrogen, or in mixtures of such gases, or in vacuum. The heating must be sufficient to permit the individual particles of polymer to, at least, sinter. Preferably, the heating must be sufficient to permit the polymer to spread into a substantially continuous film of the proper thickness and to cause it to become firmly adherent to the blade edge material.

RADIO FREQUENCY HEATING

Radio frequency heating overcomes the shortcomings of all the prior conventional heating processes. It opens a larger process window than infrared heating and provides rapid heating, cooling and space savings by virtue of the fact that only the exposed outer surface of the blade edge is actually heated. Any radio frequency energy capable of heating the blade edges may be used in the present invention. Microwave (300 MHz to 30 GHz) emissions are the preferred radio frequency source. For razor blade edge applications, we typically heat polytetrafluoroethylene (PTFE) coatings on the blade edges using microwaves of 2.45 GHz frequency having a wavelength of about 12 cm. The time variation of electric field induces an electric current at the surface of the blade edges and thus, only the surface skin is heated enough to melt and flow the polytetrafluoroethylene coatings. In addition, due to selective heating, after the edge-surface is rapidly heated to melt and flow the PTFE, the blade body acts as a heat sink, resulting in more rapid cooling than infrared heating. This effect can be enhanced by chilling the razor blade to from about 5° to about 20° C. prior to, during and/or after the microwave treatment. This implies that a production unit can be made shorter due to elimination of a cooling chamber or by reduction in cooling chamber size, resulting also in space savings.

Radio frequency energy, particularly microwave energy, is known to heat metals very efficiently. The physical principle is called Joule heating. Similar to induction heating, where magnetic energy is transformed into heat, radio frequency heating uses both electric and magnetic fields to heat a conducting material. Heating occurs when surface currents are induced in a metal. The mathematical expression describing the current flow is $$J = \nabla \wedge H - \frac{dD}{dt}$$

where J is the induced current, H is the magnetic field, D is the electric field and t is time. In simple terms this equation means that a current can be generated by the curl of the magnetic field or the time derivative of the electric field at the metal surface. The currents at microwave frequencies flow mainly in the surface layer of the metal due to skin effects. The skin effect is in principle due to the fact that the electric field is always equal to zero inside a perfect metal, a current must then flow at the surface in order to satisfy the electromagnetic boundary conditions. The skin depth is approximately 1 micrometer at 2.45 GHz. This means that most of the blade heating occurs on a skin exposed to the microwave fields. The heating is then generated by Ohmic loss. The power dissipated in heat corresponds to $$P = \tfrac{1}{2} I^2 R$$

where I is the current and R the resistance. In the case of a microwave electromagnetic field radiating on a metal surface, the equation becomes $$P = 1/2 J^2 \frac{A}{\sigma\delta}$$

where A is the metal surface area, $\sigma$ is the conductivity and $\delta$ is the skin depth.

$$\delta = \frac{1}{\sqrt{f}}$$

The skin depth is proportional to the inverse square root to the excitation frequency f. This is why microwaves are more efficient for heating blades: the heating process starts from the exposed outer surface first, then the rest of the body is heated by conduction.

Heating uniformity is a very important issue. Since the microwave power transfer equation is a vectorial equation, it is important to know what the effect of the directionality of the magnetic and electric fields. The microwave wavelength at 2.45 GHz is approximately 12 cm, which means that for an actual production situation a blade carrier would be exposed to more than one phase of the microwave power spatial distribution.

A common problem with microwave heating in a multimode (household) oven is that metallic materials and those materials with high levels of conductive metals tend to arc. Arcing of this type can cause detrimental pitting on the razor blade cutting edge. Applicants have found that by carefully tuning the microwave chamber to minimize reflected power, arcing can be eliminated. This is most effectively done on a single-mode cavity. For a discussion of single and multimode cavities see Gandhi, *Microwave Engineering & Application,* Pergamon Press, N.Y. (1935) and Asmussen et al., *Rev. Sc., Instrum.,* 58(8), pp 1477–1486, (1987), incorporated herein by reference. A single mode cavity running in $TE_{112}$ mode is most preferred.

The blade should be positioned in the cavity such that the blade is either perpendicular to or parallel to the electric field. FIG. 1 depicts a single mode microwave chamber 1 operating in Transverse Electric mode 112 ($TE_{112}$). The magnetic field H is shown in broken line form. The Electric Field E is shown in solid arrow form. In this depiction the electric field E is perpendicular to the razor blade 2 which is positioned at the base of the chamber 1. As can be seen from the depiction the resulting magnetic field H is running parallel to the length of the razor blade 2. The razor blade cutting edge 3 is positioned at the top of this figure. It is important that only the razor blade cutting edge 3 (i.e. the portion to be treated) is allowed to penetrate into the magnetic Field H. Otherwise, the energy fields may become disturbed which can produce a multi-mode type of effect. This may result in arcing and damage to the blades. Rapid heating of the blade edge surface to the melting point of the polymer is desirable. Applicants have found that sixty three razor blades with a thickness of 0.004 inches can be heated with up to 1200 W of power to achieve good adhesion of a PTFE polymer in about 15 seconds. When the power is raised too high deflected energy losses become a problem.

The heating conditions, i.e., maximum temperature, length of time, etc., must be adjusted so as to avoid substantial decomposition of the polymer and/or excessive tempering of the metal of the cutting edge. Preferably the temperature should not exceed 430° C.

Although particular embodiments of the present invention have been shown and described, modification may be made to the method without departing from the teachings of the present invention. Accordingly, the present invention comprises all embodiments within the scope of the appended claims.

The following specific examples illustrate the nature of the present invention. The quality of the first five shaves obtained with the blades of each of the following examples is equal to or better than the quality obtained with the fluorocarbon-polymer-coated blades manufactured with a chlorofluorocarbon solvent presently available; and the decrease in quality with successive shaves in the case of blades of each particular example is less than, or equal to, the decrease in quality in the case of the fluorocarbon polymer-coated blades manufactured with conventional heating.

EXAMPLE 1

A dispersion containing 10% by weight of Vydax 1000 (E.I. DuPont de Nemours) a PTFE (numbers average molecular weight of about 25,000) dispersion in Freon® fluorocarbon solvent in isopropanol was prepared and homogenized with an ultrasonic disperser. Stainless steel razor blade cutting edges were then sprayed with the dispersion. After drying, ¼ inch of blades were stacked in the microwave cavity model CMPR™ of MCR 1300 of Wavemat Inc., Plymouth, Mich. The entire cavity was flushed with nitrogen at 10 SCFH (standard cubic foot/hour) for 15 minutes. The microwave was tuned in such a way that the electric field generated by the microwaves was parallel to the blade edge ($TM_{112}$ mode). A power of 900 watts was applied to the blades for twenty seconds with the maximum heating temperature of 400° C. (surface). The blades so treated exhibited equivalent blade performance and similar coating durability as similar blades which had been treated in an infrared oven.

EXAMPLE 2

A dispersion containing 10% by weight of Vydax 1000 (E.I. DuPont de Nemours) in isopropanol was prepared and homogenized with ultrasonic dispenser. Stainless steel razor blade cutting edges were then sprayed electrostatically with the dispersion. After drying, ¼ inch blades were stacked in the microwave cavity model DMPR™ 250 of MCR 1300 of Wavemat Inc., Plymouth, Mich. The entire cavity was flushed with nitrogen for 5 minutes. The microwave was tuned in such a way that the electric field generated by the microwaves was perpendicular to the blade edge. A power of 536 watts was applied to the blade performance. The blades so treated exhibited better coating durability than similar (conventionally prepared) blades which had been treated in an infrared oven.

EXAMPLE 3

A dispersion containing 10% by weight of Vydax 1000 (E.I. DuPont de Nemours) in isopropanol was prepared and homogenized with an ultrasonic dispenser. A 1000 Angstrom coating of Diamond-Like-Carbon (DLC) is applied to the razor blade by the method described in U.S. Pat. Nos. 5,142,785 and 5,232,568. Next the blade cutting edges were electrostatically sprayed with the dispersion. After drying, ¼ inch of blades were stacked in the microwave cavity, model CMPR™ 250 of MCR 1300, mfg. by Wavemat Inc. Plymouth, Mich. The entire cavity was flushed with nitrogen for 5 minutes. The microwave cavity was tuned in such a way that the electric field generated by the microwaves was perpendicular to the blade edge. A power of 536 Watts was applied to the blades for 15 seconds to reach 375° C. (surface). The blades so treated exhibited better blade performance and better coating durability than similar blades which had been heated in an infrared oven.

What is claimed is:

1. A method of manufacturing a razor blade having a coating of polymeric material disposed on the cutting edge surface thereof which includes the steps of:

a) providing a single mode cavity operating in Transverse Electric mode 112 having a non-oxidizing atmosphere therein and a means for delivering microwave enemy having a frequency of from about 300 MHz to about 30 GHz;

b) applying a polymeric material to the edge of the blade; and retaining said blade in said cavity whereby the heat induced by said radio frequency energy is effective to raise the temperature of the coated edge surface of said blade and causing said polymeric material to melt, wherein said razor blade edge is positioned perpendicular to or parallel to the electric field and said single mode cavity is tuned to minimize reflected power.

2. A method according to claim 1 wherein said polymeric material is selected from the group consisting of fluorocarbon polymers, silicone-based polymers or mixtures thereof.

3. A method according to claim 2 wherein said polymeric material is a polymer of tetrafluoroethylene.

4. A method according to claim 3 wherein the temperature of the coated edge surface does not exceed 430° C.

5. A method according to claim 4 wherein step b) the polymeric material is applied to the edge of the blade by dipping or spraying a coating of the polymer dispersed in solvent on said blade edge.

6. A method according to claim 5 wherein said solvent is selected from the group consisting of water, volatile organic solvents, fluorocarbon solvents or miscible combinations thereof.

7. A method according to claim 6 wherein said dispersion is electrostatically sprayed on to said edge surface.

8. A method according to claim 6 wherein said microwave energy has a frequency of about 2.45 GHz.

9. A method according to claim 6 wherein said dispersion is preheated prior to step b).

10. A method according to claim 6 wherein said razor blade is chilled to a temperature of from about 5° C. to about 20° C. prior to step c).

11. A method according to claim 6 wherein said razor blade is chilled to a temperature of from about 5° C. to 20° C. during step c).

12. A method according to claim 6 wherein said razor blade is chilled to a temperature of from about 5° C. after step c).

13. A method according to claim 6 wherein said razor blade is positioned such that only the razor blade cutting edge is allowed to penetrate into the magnetic field.

* * * * *